US011519431B2

(12) United States Patent
Mezzino et al.

(10) Patent No.: US 11,519,431 B2
(45) Date of Patent: Dec. 6, 2022

(54) HYDRAULIC ACTUATOR

(71) Applicant: Microtecnica S.r.l., Turin (IT)

(72) Inventors: Giacomo Mezzino, Turin (IT); Franco Maino, Brugherio (IT); Dario Molinelli, Carnate (IT)

(73) Assignee: MICROTECNICA S.R.L., Turin (IT)

( * ) Notice: Subject to any disclaimer, the term of this patent is extended or adjusted under 35 U.S.C. 154(b) by 0 days.

(21) Appl. No.: 17/369,115

(22) Filed: Jul. 7, 2021

(65) Prior Publication Data

US 2021/0332833 A1 Oct. 28, 2021

Related U.S. Application Data

(63) Continuation of application No. 16/711,837, filed on Dec. 12, 2019, now Pat. No. 11,085,464.

(30) Foreign Application Priority Data

May 28, 2019 (EP) ..... 19177096

(51) Int. Cl.
*F15B 11/10* (2006.01)
*F15B 15/14* (2006.01)

(52) U.S. Cl.
CPC ..... *F15B 11/10* (2013.01); *F15B 15/149* (2013.01); *F15B 15/1433* (2013.01)

(58) Field of Classification Search
CPC . F15B 15/1433; F15B 15/1438; F15B 15/149
USPC ..... 92/119
See application file for complete search history.

(56) References Cited

U.S. PATENT DOCUMENTS

| | | | |
|---|---|---|---|
| 908,414 | A | 12/1908 | Mellin |
| 1,534,439 | A | 4/1925 | Burkhardt et al. |
| 3,152,522 | A | 10/1964 | Burden et al. |
| 3,202,062 | A | 8/1965 | Burden |
| 3,314,336 | A | 4/1967 | Jorgji |
| 4,969,389 | A | 11/1990 | Foster |
| 6,516,706 | B2 | 2/2003 | Porter et al. |
| 2006/0230649 | A1 | 10/2006 | Gusella |
| 2020/0378407 | A1 | 12/2020 | Mezzino et al. |

FOREIGN PATENT DOCUMENTS

| | | | |
|---|---|---|---|
| DE | 102007059603 | A1 | 12/2007 |
| EP | 1688546 | A2 | 8/2006 |

OTHER PUBLICATIONS

Extended European Search Report for International Application No. 19177096.5 dated Nov. 26, 2019, 8 pages.

*Primary Examiner* — Michael Leslie
*Assistant Examiner* — Matthew Wiblin
(74) *Attorney, Agent, or Firm* — Cantor Colburn LLP

(57) ABSTRACT

A hydraulic actuator is disclosed that comprises a first, fixed portion and a second portion movable relative to the first portion. The second portion comprises a hydraulic actuating device for actuating a component, and the actuator further comprises an intermediate member configured to interconnect the first portion with the second portion and permit movement of the second portion relative to the first portion. The intermediate member is configured to convey hydraulic fluid to the hydraulic actuating device of the second portion through a body of the intermediate member.

11 Claims, 6 Drawing Sheets

HYDRAULIC ACTUATOR

CROSS REFERENCE TO RELATED APPLICATIONS

This application is a continuation application of the legally related U.S. Ser. No. 16/711,837 filed Dec. 12, 2019, which claims priority to European Patent Application No. 19177096.5 filed May 28, 2019, the entire contents of which are incorporated herein by reference.

FIELD

The present disclosure relates generally to a hydraulic actuator.

BACKGROUND

Hydraulic actuators are known and typically comprise a cylinder or fluid motor that uses hydraulic power to facilitate mechanical operation, wherein the mechanical motion gives an output in terms of linear, rotatory or oscillatory motion. Due to most liquids being substantially impossible to compress, a hydraulic actuator can exert a large force.

The hydraulic cylinder may comprise a hollow cylindrical tube along which a piston can slide. The piston may move in only one linear direction (e.g., back and forth). Fluid pressure may be applied on each side of the piston, wherein any difference in pressure between the two sides of the piston moves the piston to one side or the other.

In many cases a hydraulic servovalve is used to control the fluid pressure on either side of the piston, and this may require a supply and return of hydraulic fluid to the servovalve. In the case of a hydraulic actuator that requires rotary motion, it can be difficult to supply the hydraulic fluid to the servovalve. This is because the servovalve is typically located on the component that rotates, and so electrical and fluid connections must be provided to the servovalve. Ensuring that the electrical and fluid connections are able to rotate with the actuator can be challenging. When considering these factors, it is also desired to decrease the size of the actuator as much as possible.

Therefore, it is desired to improve the fluid and electrical connections to a servovalve located on a hydraulic actuator, so as to increase the efficiency thereof whilst reducing or at least maintaining the size of the actuator as much as possible.

SUMMARY

From a first aspect there is provided a hydraulic actuator, which comprises a first, fixed portion and a second portion movable relative to the first portion. The second portion comprises a hydraulic actuating device for actuating a component. The actuator further comprises an intermediate member configured to interconnect the first portion with the second portion and permit movement of the second portion relative to the first portion, wherein the intermediate member is configured to convey hydraulic fluid to the hydraulic actuating device of the second portion through a body of the intermediate member.

This arrangement, and in particular the use of an intermediate member to convey hydraulic fluid, reduces or minimises the fluid links that would otherwise need to be provided between the fixed and moving portions of the actuator. For example, there is no need to use a separate hydraulic cable or conduit, which can inhibit the movement of the moving portion of the actuator.

The intermediate member may comprise a plurality of fluid inlet or outlet ports spaced substantially equally about a circumference or longitudinal axis thereof. This means that the hydraulic forces on the intermediate member are balanced. For a similar reason (and additionally or alternatively) the intermediate member may comprise a plurality of fluid conduits spaced substantially equally about a longitudinal axis thereof.

The second portion may be linked to the first portion via a ball and socket joint. This is seen as an optimum type of connection for the first and second portions, since it permits a large amount of movement between the two components.

In refinements of these embodiments, the ball of the ball and socket joint may be formed by a portion of the intermediate member, and the socket may be formed by the first portion. The first portion may comprise a first body and a second, separate body. The first and second bodies together may form the socket of the ball and socket joint. The second body may plug into the first body to hold the ball in place within the combination of the first and second bodies, which may be fixed relative to each other once the second body is plugged into the first body.

The portion of the intermediate member forming the ball may comprise a plurality of fluid inlet or outlet ports spaced substantially equally about a circumference or longitudinal axis thereof. This means that the hydraulic forces on the intermediate member are balanced.

The portion of the intermediate member forming the ball may be in the shape of a truncated sphere, such that a flat surface is formed by the truncated section of the sphere, and a plurality of fluid inlet or outlet ports may be located in the flat surface of the truncated section. Using a truncated sphere has been found to simplify positioning and machining of the fluid ports located in its surface. In addition, providing the fluid ports in the flat surface of the truncated section has been found to improve fluid delivery into and out of the intermediate member, as well as the balance of hydraulic forces on the intermediate member.

The intermediate member may comprise a spherical or partly-spherical portion comprising a centre point, wherein a plurality of fluid inlet or outlet ports are spaced equally about a circumference of the spherical portion. This has also been found to improve fluid delivery into and out of the intermediate member, as well as the balance of hydraulic forces on the intermediate member. Each fluid inlet or outlet port may be fluidly connected to a central supply conduit of the intermediate member via a respective radial supply conduit.

The intermediate member may comprise a central longitudinal axis and a plurality of fluid inlet or outlet ports, wherein the plurality of fluid inlet or outlet ports may be spaced equally about a circumference of the intermediate member (e.g., relative to the central longitudinal axis). This has also been found to improve fluid delivery into and out of the intermediate member, as well as the balance of hydraulic forces on the intermediate member. Each fluid inlet or outlet port may be fluidly connected to a central supply conduit that runs along the intermediate member via a respective radial supply conduit.

The central supply conduit, in any of the embodiments including one, may run along and/or parallel to the longitudinal axis of the intermediate member. The radial supply conduits may extend from the centre point, and/or the central longitudinal axis to a respective supply inlet port in a radial direction with respect to the centre point and/or the central longitudinal axis of the intermediate member.

In any of the aspects and embodiments described herein, the hydraulic actuating device may comprise a piston connected to an actuating arm, such that movement of the piston causes actuation of the actuating member for actuating a component connected thereto.

The second portion may comprises a cavity within which the piston moves, and the piston and cavity may define one or more chambers of varying volume depending on the position of the piston within the cavity.

The hydraulic actuator may further comprise a servovalve located on the second portion and configured to supply hydraulic fluid to the chambers for moving the piston within the cavity and actuating a component connected to the actuating member.

From an aspect there is also provided a method of operating a hydraulic actuator as claimed in any preceding claim, the method comprising conveying hydraulic fluid to the hydraulic actuating device through the body of the intermediate member, so as to actuate a component connected to or otherwise associated with the hydraulic actuating device.

BRIEF DESCRIPTION OF THE DRAWINGS

Various embodiments will now be described, by way of example only, and with reference to the accompanying drawings in which.

DETAILED DESCRIPTION

Herewith will be described various embodiments of a hydraulic actuator that comprises a hydraulic piston configured to rotate and tilt, wherein fluid connections to the servovalve and/or the piston are located within the ball of a ball and socket joint about which the hydraulic piston rotates and tilts, which means that such fluid connections do not inhibit the ability of the hydraulic piston to rotate and tilt.

Figure 1:
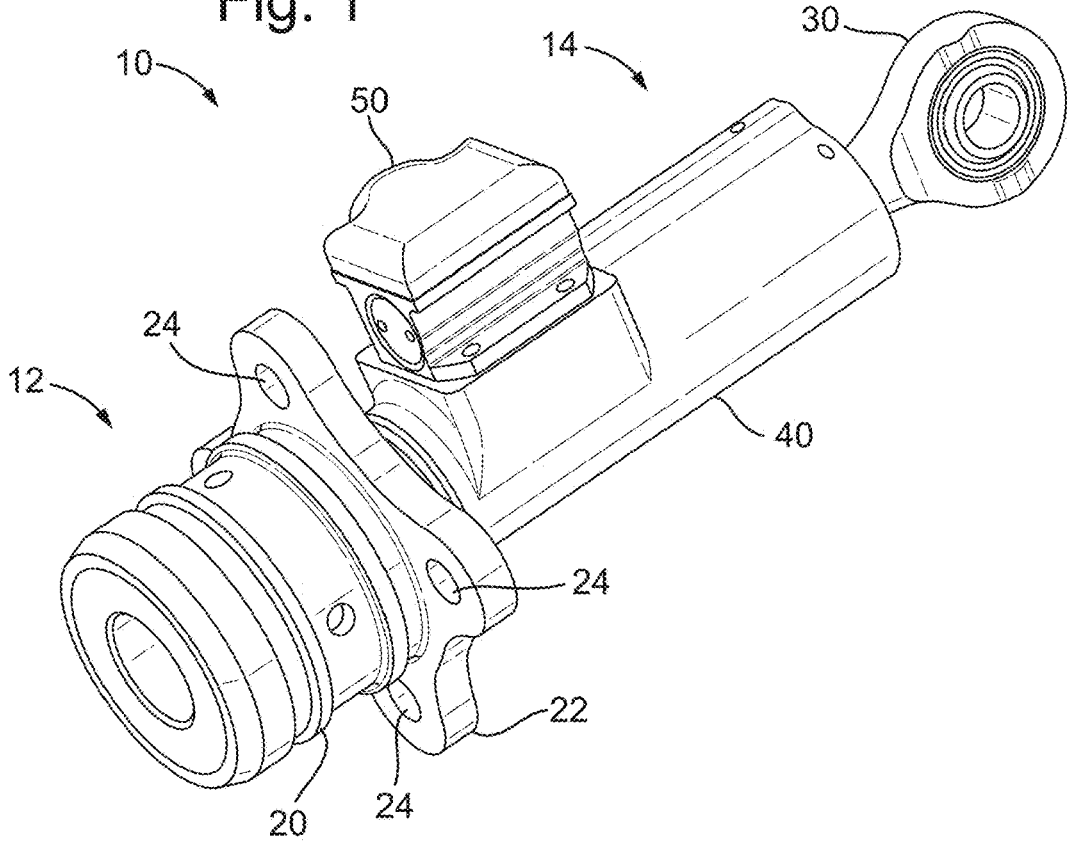
FIG. 1 shows a hydraulic actuator in accordance with an embodiment.

FIG. 1 shows an actuator 10 in accordance with an embodiment, the actuator 10 comprising a first, fixed (or static) portion 12 and a second, movable portion 14, wherein the first portion 12 is configured to be fixed in position with respect to an apparatus that the actuator 10 is attached to (e.g., an aircraft housing). The second portion 14 is configured to move relative to the first portion 12, and specifically tilt and rotate relative to the first portion 12 as discussed in more detail below.

The first portion 12 may comprise a plug 20 for attaching to a housing (which may comprise hydraulic equipment), which plug 20 may extend from a mounting flange 22 and comprise various inputs and outputs for hydraulic fluid. The mounting flange 22 may comprise one or more apertures 24 configured to mount the actuator 10 to an apparatus as described above. Suitable fasteners (not shown) may extend through the apertures 24 for this purpose.

The second portion 14 is movable relative to the first portion 12, and in the illustrated embodiment a ball and socket joint is located between the first portion 12 and the second portion 14, to allow the second portion 14 to rotate and tilt relative to the first portion 12. Other types of joint or connection between the first and second portions 12, 14 are envisaged and within the broadest aspects of the present disclosure.

The second portion 14 may comprise an actuating member 30 configured to operatively connected to a component to be actuated (e.g., an aircraft flight control surface). The actuating member 30 in the illustrated embodiment comprises a spherical joint 31 for connecting to a component, although any type of connection may be employed and the disclosure should not be seen as being limited to a spherical joint as shown.

The second portion may further comprise a servovalve 50 configured to control the passage of hydraulic fluid to a piston 60 (FIG. 2) and actuate the actuating member 30 in use. The second portion 14 comprises a body 40 configured to house the piston.

Figure 2:
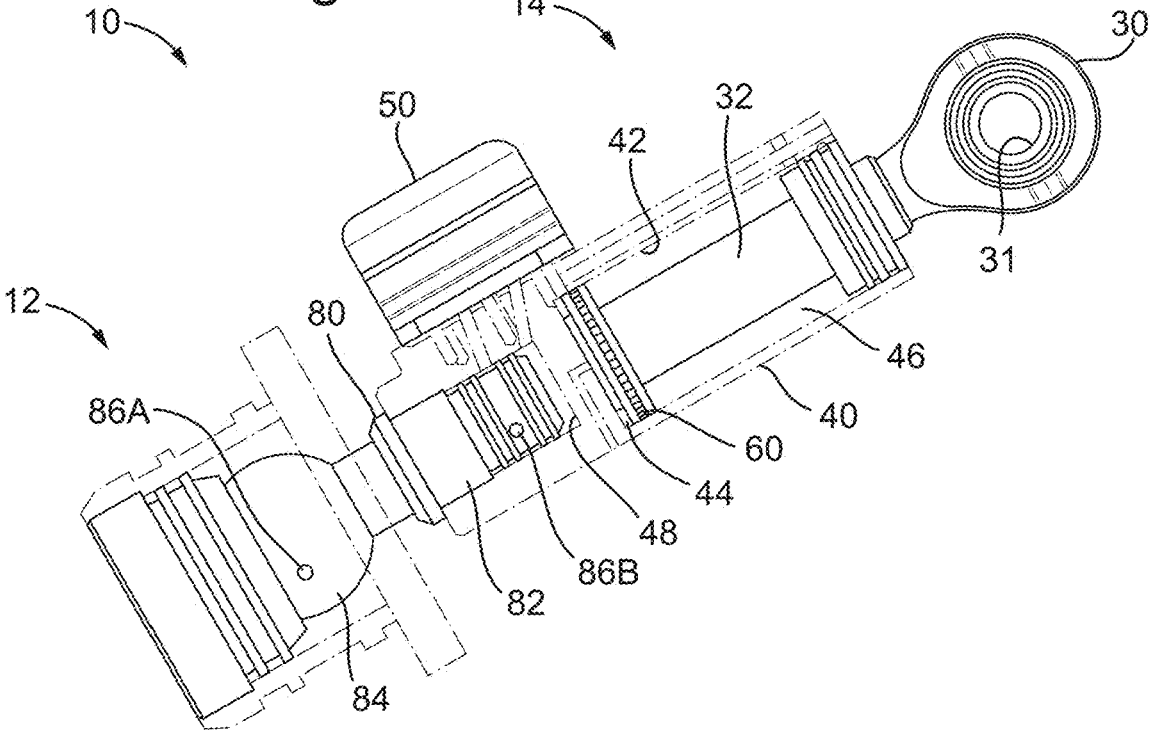
FIG. 2 shows the actuator with certain portions cut away, and the interior of the actuator in more detail.

FIG. 2 shows the actuator 10 with certain portions cut away, and showing the interior of the actuator 10 in more detail.

The actuator 10 comprises the piston 60 that is located within the body 40 and moves within a cylindrical cavity 42 of the body. The piston 60 is connected to an actuating arm 32 that is itself connected to the actuating member 30, such that movement of the piston 60 within the cavity 42 causes actuation of the actuating member 30. Any suitable hydraulic actuation device or mechanism may be used with the disclosed technology, for example other piston architectures such as a double piston cylinder, etc.

The piston 60 and cavity 42 define chambers 44, 46 of varying volume depending on the position of the piston 60 within the cavity 42. The piston 60 is shown in FIG. 2 in its retracted state, in which the actuating member 30 is in a fully retracted position. In this position, a first of the chambers 44 has a minimum volume, and a second of the chambers 46 has a maximum volume. It will be appreciated that in a fully extended position the piston 60 will be located at the opposite end of the cavity 42, and such that the first chamber 44 has a maximum volume and the second chamber 46 has a minimum volume.

The position of the piston 60 within the cavity 42 is controlled by the servovalve 50, and specifically the servovalve 50 supplies hydraulic fluid to one or other of the chambers 44, 46 so as to cause movement of the piston 60 within the cavity 42. Suitable supply and return fluid conduits may be provided between the servovalve 50 and the chambers 44, 46 as is known in the art. This operation of hydraulic actuators is known by the skilled person and will not be described in more detail herein.

The actuator 10 may further comprise an intermediate member or device 80 configured to interconnect the body 40 of the second portion 14 with the first portion 12. The intermediate member comprises a first portion 82 configured to plug into the body 40, and a second portion 84 held within the first portion 12 of the actuator 10. The first portion 82 and the second portion 84 may be a single piece, or may be made up of a number of pieces depending on the application at hand.

The first portion 82 of the intermediate member 80 may be inserted into a cavity 48 of the body 40 in such a manner that the intermediate member 80 moves (e.g. rotates and tilts) with the body 40 and actuating member 30.

The second portion 84 of the intermediate member 80 is partially spherical and sits within a socket of the first portion 12 of the actuator 10, such that the second portion 84 of the intermediate member 80 and the socket of the first portion 12 of the actuator 10 form a ball and socket joint, permitting rotation and tilting of the intermediate member 80, body 40 and actuating member 30.

Figure 3:
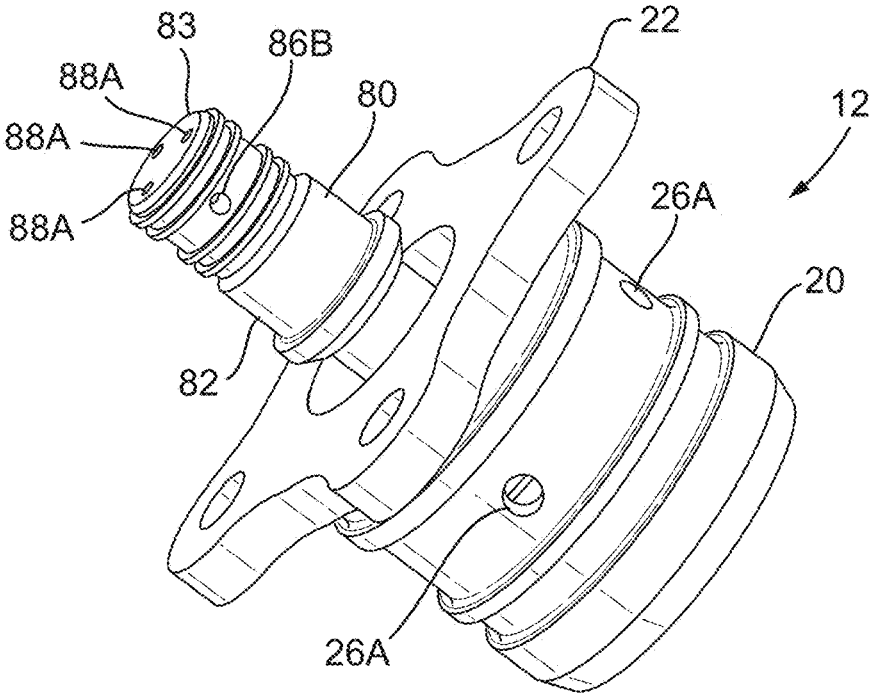
FIGS. 3 and 4 show an intermediate member and first portion of the actuator in isolation.
Figure 4:
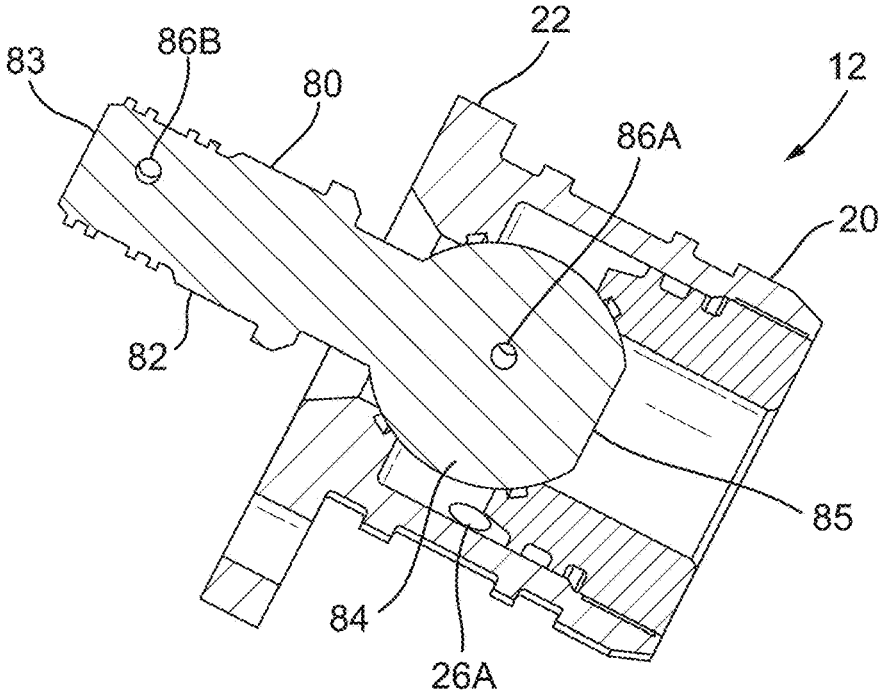

FIGS. 3 and 4 show the intermediate member 80 and first portion 12 of the actuator 10 are shown in isolation.

The intermediate member 80 comprises a plurality of ports that are fluid inlets and outlets, and these are located at specific portions of the intermediate member 80.

A plurality of supply inlet ports 86A are located on the spherical portion of the second portion 84 of the intermediate member 80, and are configured to receive hydraulic supply fluid from a source of hydraulic supply fluid, e.g., in the first portion 12 of the actuator 10.

A plurality of supply outlet ports 86B are located on the first portion 82 of the intermediate member 80, and are configured to convey hydraulic fluid that has been received through the supply inlet ports 86A to the servovalve 50, for example via one or more conduits in the body 40.

Figure 5:
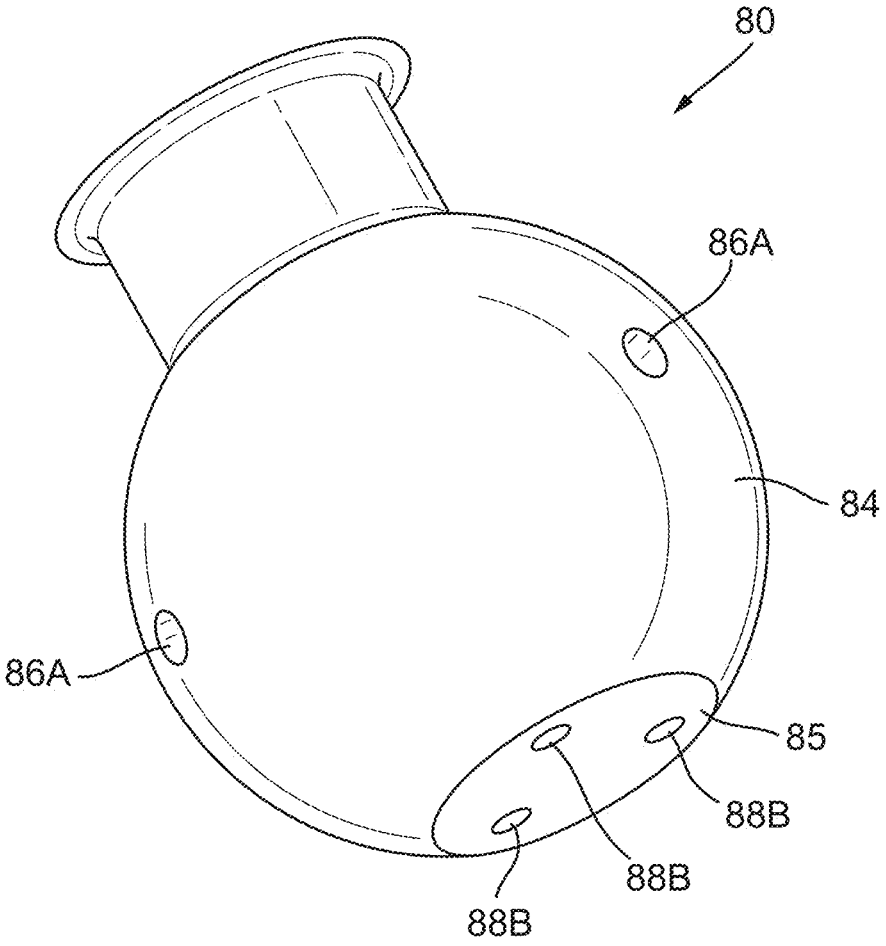
FIG. 5 shows the second portion of the intermediate member in isolation.

The intermediate member 80 comprises a first end 83 and a second, opposite end 85, wherein a plurality of return inlet ports 88A are located in the first end 83, which return inlet ports 88A are configured to receive hydraulic return fluid from the servovalve 50. As shown in FIG. 5, which shows the second portion 84 of the intermediate member 80 in isolation, a plurality of return outlet ports 88B are located in the second end 85 of the intermediate member 80, which return outlet ports 88B are configured to convey hydraulic fluid that has been received through the return inlet ports 88A to the first portion 12 of the actuator 10.

Figure 6:
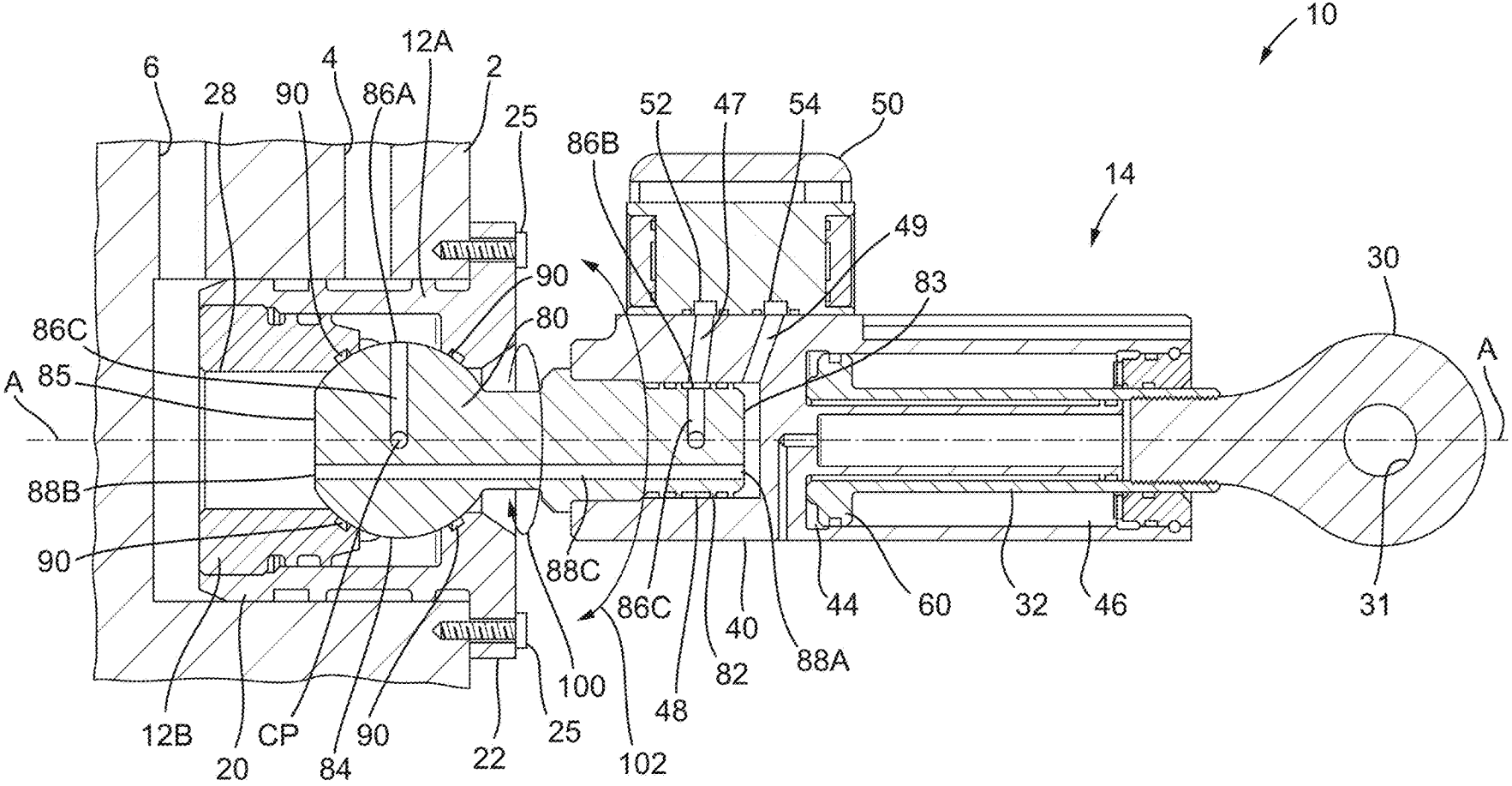
FIG. 6 shows a cross-section through the actuator.

FIG. 6 shows a cross-section through the actuator 10.

The actuator 10 (e.g., the plug 20 thereof) is shown as being mated with a housing 2 that may form part of an apparatus. As discussed above, the actuator 10 may be fastened to the housing 2 using suitable fasteners 25 that extend through respective apertures 24 of the mounting flange 22.

The housing 2 comprises a hydraulic fluid supply conduit 4 that is fluidly connected to a source of hydraulic fluid and for supplying hydraulic fluid to the actuator 10, as well as a hydraulic fluid return conduit 6 for returning hydraulic fluid that has been supplied to the actuator 10.

The hydraulic fluid supply conduit 4 is fluidly connected to the supply inlet ports 86A, such that hydraulic fluid will flow from the hydraulic fluid supply conduit 4 and enter the supply inlet ports 86A, for example via suitable inlets 26A (FIG. 3) located in the body of the plug 20.

The supply inlet ports 86A are fluidly connected to the supply outlet ports 86B via one or more supply conduits 86C of the intermediate member 80, which supply conduits 86C are configured to convey hydraulic fluid from the supply inlet ports 86A to the supply outlet ports 86B. The supply conduits 86C extend into and are located within the body of the intermediate member 80.

After leaving the supply outlet ports 86B, hydraulic fluid then flows to one or more supply inlet ports 52 of the servovalve 50, e.g., via one or more supply conduits 47 located in the body 40 of the actuator 10. This provides the requisite hydraulic supply fluid for the servovalve 50.

The servovalve 50 further comprises a return outlet port 54 that communicates return hydraulic fluid to the return inlet ports 88A of the intermediate member 80, e.g., via one or more return conduits 49 located in the body 40 of the actuator 10.

The return inlet ports 88A are fluidly connected to the return outlet ports 88B via one or more return conduits 88C of the intermediate member 80, which return conduits 88C are configured to convey hydraulic fluid from the return inlet ports 88A to the return outlet ports 88B. The return conduits 88C extend into and are located within the body of the intermediate member 80.

After leaving the return outlet ports 88B, hydraulic fluid then flows through an outlet conduit 28 of the first portion 12 of the actuator 10 and is communicated to the hydraulic fluid return conduit 6.

As will be appreciated from the above description, hydraulic fluid is communicated to the servovalve 50 via the intermediate member 80 and does not require additional or external piping or conduits between the housing 2 and the servovalve 50. This permits an increased mobility of the second portion 14 of the actuator 10, for example rotation (as indicated by arrow 100) and tilting (as indicated by arrow 102). Conveying the supply and return hydraulic fluid to the servovalve 50 through the body of the intermediate member 80 avoids the need for additional structure required by conventional arrangements. The use of a ball and socket joint between the intermediate member 80 and the first portion 12 of the actuator 10 is particularly useful in this regard.

In various embodiments the supply inlet ports 86A may be equally spaced about a circumference of the spherical portion (ball) of the intermediate member 80. Due to the high pressure of the hydraulic fluid being supplied to the supply inlet ports 86A, spacing them in this manner can help to balance the forces exerted by the hydraulic supply fluid on the intermediate member 80.

In various embodiments, the intermediate member 80 may comprise a central longitudinal axis A, and the spherical portion comprises a centre point CP. Each of the supply inlet ports 86A may be spaced equally about a circumference of the spherical portion, wherein each supply inlet port 86A may be fluidly connected to a central supply conduit 86C that runs along the longitudinal axis A of the intermediate member 80 via a respective radial supply conduit 86C. The radial supply conduits 86C may extend from the centre point CP to a respective supply inlet port 86A in a radial direction. Such features can provide an optimum balance of the forces exerted by the hydraulic supply fluid on the intermediate member 80.

A similar arrangement can be found at the first portion 82 of the intermediate member 80, in that the supply outlet ports 86B may be spaced equally about a circumference of the first portion 82 of the intermediate member 80, wherein each supply outlet port 86B may be fluidly connected to the central supply conduit 86C that runs along the longitudinal axis A of the intermediate member 80 via a respective radial supply conduit 86C. The radial supply conduits 86C may extend from the central supply conduit 86C at the longitudinal axis A to a respective supply inlet port 86A in a radial direction. Again, this arrangement can provide an optimum balance of the forces exerted by the hydraulic supply fluid on the intermediate member 80, and specifically at the first portion 82 thereof.

The pressure of the hydraulic supply fluid can be 10 to 20 times greater than that of the hydraulic return fluid. As such, it may not be as important to balance the forces exerted by the hydraulic return fluid, and so although the hydraulic return conduits 88C may also be spaced equally about the longitudinal axis A of the intermediate member 80, this is not essential for the broadest aspects of the present disclosure (although would provide an improvement over an arrangement that does not do this). In order to efficiently convey the return hydraulic fluid, the hydraulic return conduits 88C may extend from the first end 83 of the immediate member 80 to the second end 85 of the intermediate member 80 in a straight line.

It will be appreciated that the spherical portion of the intermediate member 80 is shown as a truncated sphere, so that the return outlet ports 88B are all located on the same plane, namely at the second end 85 of the intermediate member 80.

Suitable seals 90 may be provided between the spherical portion of the intermediate member 80 and the first portion 12 of the actuator 10, which seals 90 may be configured to fluidly separate the supply and return portions of the actuator 10 within the first portion 12 thereof.

As discussed above the first portion 82 of the intermediate member 80 extends into a cavity 48 of the body 40. The first portion 82 of the intermediate member 80 may be held within the cavity 48 by a screw thread, or other fit such as an interference fit, or by any other suitable mechanism. For example cooperating screw threads may be provided on each of the first portion 82 and the cavity 48.

The first portion 12 of the actuator 10 may be made up of a first body 12A that comprises the mounting flange 22 and plug 20, as well as a second body 12B that is configured to fit within the first body 12A. The first body 12A and the second body 12B may combine to provide the socket of the ball and socket joint described above, wherein the spherical portion of the intermediate member 80 may be held within the socket formed by the first and second bodies 12A, 12B. The second body 12B may be used to fluidly seal the supply and return portions of the first portion 12 of the actuator 10, using suitable seals 90 as described above. This is seen as a particularly efficient arrangement for forming the ball and socket joint described herein. The intermediate member 80 may be inserted into the first body 12A initially, and then the second body 12B may be inserted or plugged into the first body 12A to hold the intermediate member 80 (e.g., the second or ball portion 84 thereof) in place.

Figure 7:
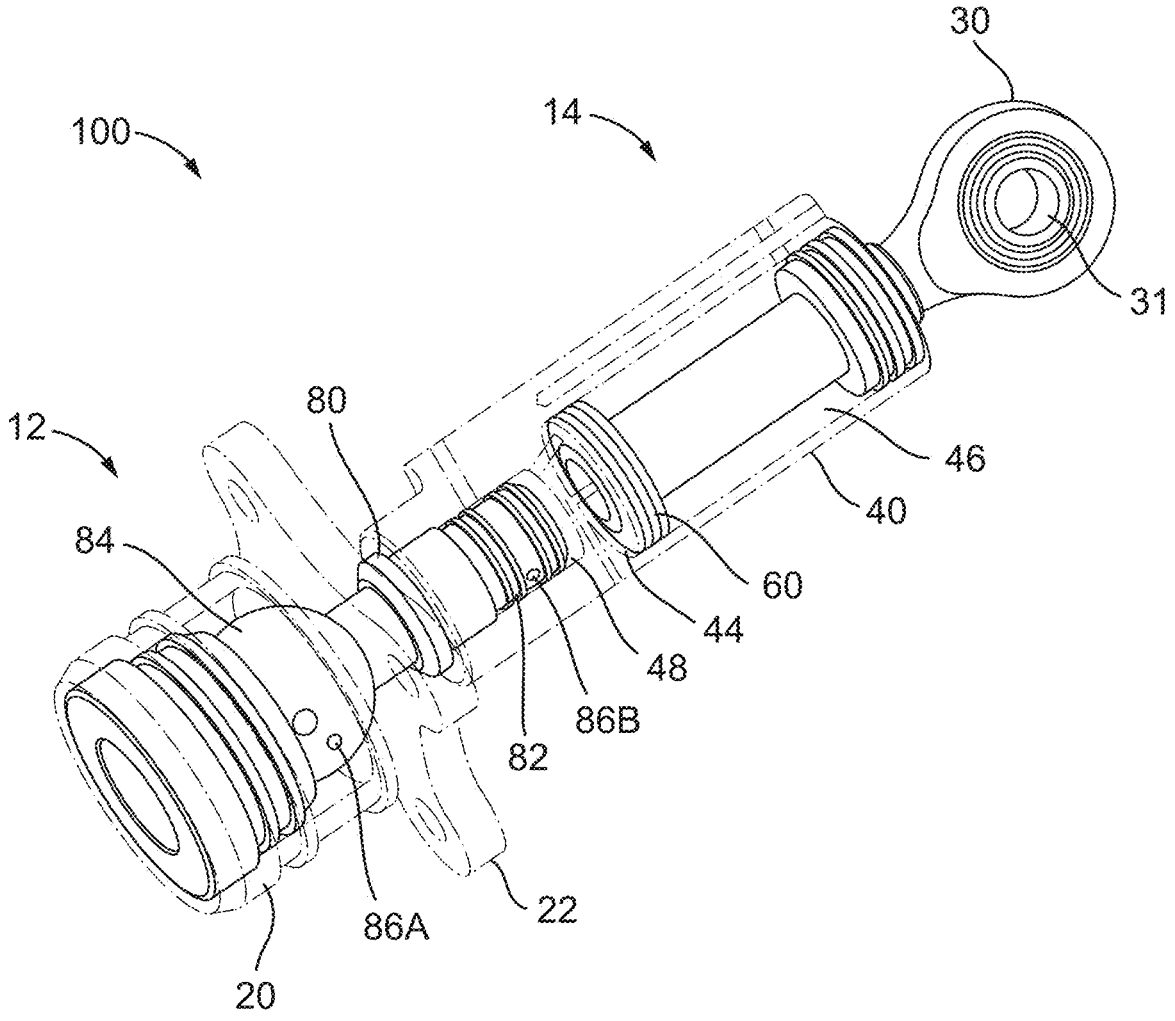
FIGS. 7 and 8 show an embodiment of an actuator similar to that of FIGS. 1 to 6, but in which a servovalve is not provided on the moving portion of the actuator.
Figure 8:
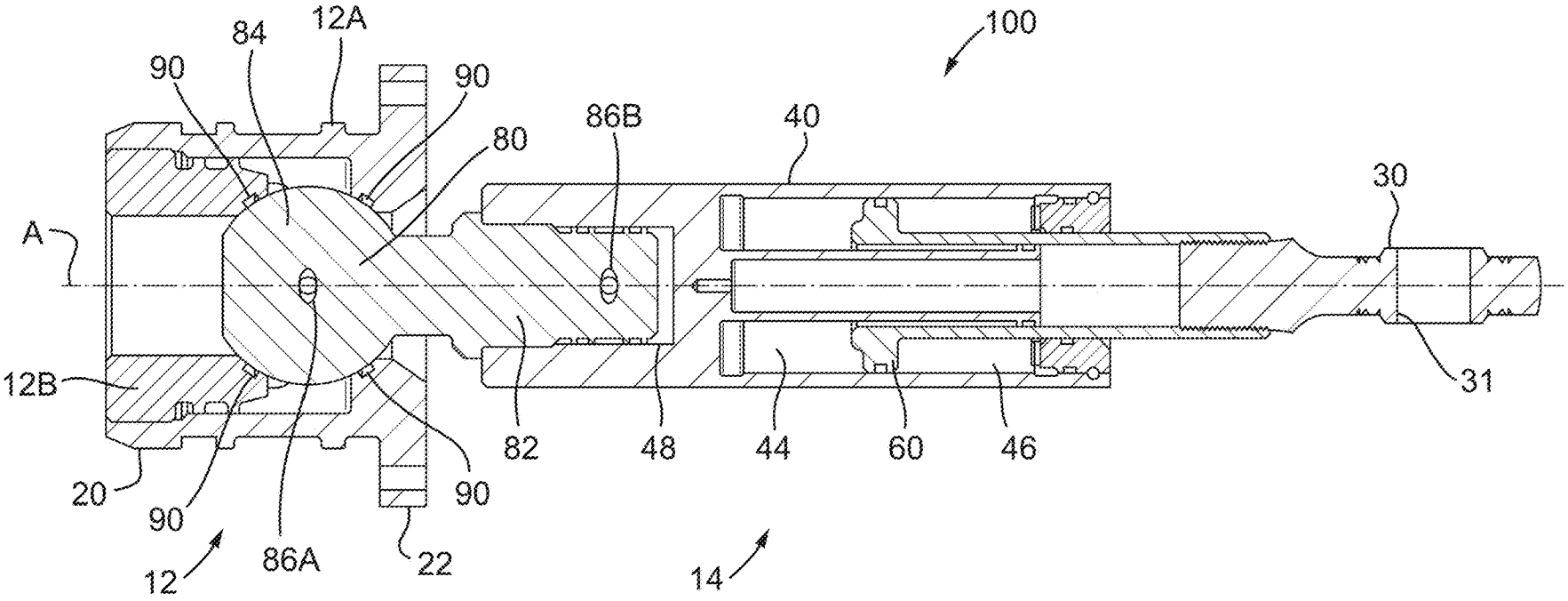

FIGS. 7 and 8 show an embodiment of an actuator 100 similar to that of FIGS. 1 to 6, but in which a servovalve is not provided on the moving portion of the actuator 10.

The actuator 100 comprises various features, in which like reference numerals indicate like elements shown and described in respect of the embodiment of FIGS. 1 to 6, wherein some differences will become apparent from the description below. Similar to the actuator 10 described above, the actuator 100 comprises a plug 20 and mounting flange 22 for mounting the actuator 100 to a housing. Hydraulic fluid is supplied from the first portion 12 of the actuator 100 to the second portion 14 of the actuator 100 via an intermediate member or device 80. However, instead of the hydraulic fluid being supplied to a servovalve, and then distributed to the first and second chambers 44, 46 for operating the actuating member 30, hydraulic fluid is supplied at sufficient pressure to be directly conveyed to the first chamber 44 and the second chamber 46. In other words, the servovalve may be located on the fixed portion of the housing, and the hydraulic fluid supplied directly to the chambers 44, 46 via the intermediate member 80.

It will be appreciated that the intermediate member 80 is substantially the same as that described in respect of the previous embodiment, and any of the above described arrangements of the intermediate member 80 may be used in the same manner in the embodiment of FIGS. 7 and 8.

FIG. 8 shows a cross-section of the actuator 100, in which the actuating member 30 is extended to roughly 50% of its extension. Hydraulic fluid may be supplied or returned through supply and return conduits located through the body of the intermediate member 80, which will switch between acting as supply and return conduits depending on the direction of movement of the actuating member 30.

By removing the servovalve from the second portion 14 of the actuator 100 and any associated electrical cables are also removed between the second portion 14 and either the first portion 12 of the actuator 100 or other portions of the wider apparatus. As such, the range of movement of the moving portion of the actuator 100 is increased. For example, complete 360° rotation is permitted, which may not be possible in the previous embodiment due to electrical cables being connected to the servovalve 50 located on the moving portion of the actuator 10.

Although the present disclosure has been described with reference to various embodiments, it will be understood by those skilled in the art that various changes in form and detail may be made without departing from the scope of the invention as set forth in the accompanying claims.

What is claimed is:

1. A hydraulic actuator comprising:

a first, fixed portion;

a second portion movable relative to the first portion, and comprising a hydraulic actuating device for actuating a component;

an intermediate member configured to interconnect the first portion with the second portion and permit movement of the second portion relative to the first portion, wherein the intermediate member is configured to convey hydraulic fluid to the hydraulic actuating device of the second portion through a body of the intermediate member;

wherein the second portion is linked to the first portion via a ball and socket joint;

wherein a ball of the ball and socket joint is formed by a portion of the intermediate member, and a socket is formed by the first portion; and wherein the portion of the intermediate member forming the ball is in a shape of a truncated sphere such that a flat surface is formed by a truncated section of the truncated sphere, and a plurality of fluid inlet or outlet ports are located in the flat surface of the truncated section.

2. A hydraulic actuator as claimed in claim 1, wherein the plurality of fluid inlet or outlet ports are spaced substantially equally about a circumference or longitudinal axis of the intermediate member.

3. A hydraulic actuator as claimed in claim 1, wherein the intermediate member comprises a plurality of fluid conduits spaced substantially equally about a longitudinal axis thereof.

4. A hydraulic actuator as claimed in claim 1, wherein the first portion comprises a first body and a second, separate body, and the first and second bodies together form the socket of the ball and socket joint.

5. A hydraulic actuator as claimed in claim 4, wherein the plurality of fluid inlet or outlet ports are spaced substantially equally about a circumference or longitudinal axis of the intermediate member.

6. A hydraulic actuator as claimed in claim 1, wherein the intermediate member comprises a central longitudinal axis and another plurality of fluid inlet or outlet ports, wherein the plurality of fluid inlet or outlet ports are spaced equally about a circumference of the intermediate member, wherein each fluid inlet or outlet port is fluidly connected to a central supply conduit that runs along the intermediate member via a respective radial supply conduit.

7. A hydraulic actuator as claimed in claim 6, wherein the central supply conduit runs along and/or parallel to the longitudinal axis of the intermediate member.

8. A hydraulic actuator as claimed in claim 6, wherein the radial supply conduits extend from the central longitudinal axis to a respective supply inlet port of the another plurality of fluid inlet or outlet ports in a radial direction with respect to the central longitudinal axis of the intermediate member.

9. A hydraulic actuator as claimed in claim 1, wherein the hydraulic actuating device comprises a piston connected to an actuating arm, such that movement of the piston causes actuation of the actuating member for actuating the component connected thereto.

10. A hydraulic actuator as claimed in claim 9, wherein the second portion comprises a cavity within which the piston moves, and the piston and cavity define one or more chambers of varying volume depending on a position of the piston within the cavity.

11. A method of operating a hydraulic actuator as claimed in claim 1, the method comprising:

conveying hydraulic fluid to the hydraulic actuating device through the body of the intermediate member, so as to actuate the component connected to or otherwise associated with the hydraulic actuating device.

* * * * *